United States Patent [19]

LeBlanc et al.

[11] Patent Number: 5,033,535

[45] Date of Patent: Jul. 23, 1991

[54] LUBRICATION SYSTEM FOR CASTING MOULDS

[75] Inventors: Guy LeBlanc, Longueuil; Vincent J. Newberry, Beaconsfield, both of Canada

[73] Assignee: Alcan International Limited, Montreal, Canada

[21] Appl. No.: 499,017

[22] Filed: Mar. 26, 1990

[51] Int. Cl.[5] ..... B22D 11/07

[52] U.S. Cl. ..... 164/472; 164/268

[58] Field of Search ..... 164/472, 268

[56] References Cited

U.S. PATENT DOCUMENTS

| | | | |
|---|---|---|---|
| 4,057,100 | 11/1977 | Lossack et al. | 164/418 |
| 4,420,030 | 12/1983 | Pryor et al. | 164/472 |
| 4,437,508 | 3/1984 | Pryor et al. | 164/418 |

FOREIGN PATENT DOCUMENTS

| | | | |
|---|---|---|---|
| 167056 | 1/1986 | European Pat. Off. | 164/268 |
| 569376 | 8/1977 | U.S.S.R. | 164/472 |
| 794255 | 4/1958 | United Kingdom | 164/472 |

*Primary Examiner*—Kuang Y. Lin

*Attorney, Agent, or Firm*—Cooper & Dunham

[57] ABSTRACT

An apparatus for casting metal includes a mould for effecting solidification of the molten metal into a formed metal product, means adjacent to an inlet portion of the mould for feeding the molten metal into the mould and means for delivering a lubricating agent to a surface of the mould contacting the molten metal to substantially prevent adhesion of anyu solidfied metal on the mould surface. According to the novel feature, the lubricating agent delivery means comprises at least one lubricant delivery channel arranged generally parallel to the mould surface, inlet means for delivering a flow of lubricant under pressure into the delivery channel, a plurality of uniformly spaced restrictive flow passages extending across between the delivery channel and lubricant outlet holes adjacent the molten metal for delivery of lubricant to the mould surface. The restrictive flow passages have dimensions such that the friction loss from lubricant flow in the lubricant delivery channel is negligible relative to the total friction loss of the total system whereby lubricant delivered under pressure to the lubricant delivery channel is transferred uniformly through said restrictive flow passages to the mould surface. The delivery channels and passages are preferably dimensioned such that friction loss from the flow of lubricant in the delivery channel is less than 10% of the total friction loss of the system.

11 Claims, 2 Drawing Sheets

LUBRICATION SYSTEM FOR CASTING MOULDS

FIELD OF THE INVENTION

This invention relates to continuous casting moulds, and more particularly to lubricating systems for effective lubrication of the mould surface.

Casting moulds are used to shape molten metal and to extract heat from this metal to form a solid casting or ingot. These moulds have two basic characteristics. The first is to extract heat to effect solidification, and the second is to provide a parting agent or lubricant to prevent adherence between the molten metal and the mould. The distribution of the lubricant over the surface of the inner mould wall has a substantial effect on the surface quality of the ingot.

For example, in continuous casting in insulated or hot top moulds, it is commonplace to use an insulating head formed of a heat resistant and insulating material, such as a refractory material, which resists contact with the molten metal to be cast. The insulating head is located at a position contiguous with or adjacent to and extending around the periphery of the top portion of the mould wall. The use of an insulating head portion provides for a relatively constant withdrawal of heat from the molten metal during the casting operation especially when using a short mould wall.

The lubrication of the walls of moulds with insulating heads has proven to be difficult. Thus, the point of contact between the molten metal and cooled mould wall where the lubricant must be applied is not readily accessible but is covered by the insulating head.

Lossack et al U.S. Pat. No. 4,057,100, issued Nov. 8, 1977, describes a lubricating system for a continuous casting mould which represents one attempt at overcoming the problems of uniform delivery of lubricant to the mould surface. They have provided a lubricant reservoir within the mould itself, which is arranged such that gravity flow of liquid cannot occur between the reservoir and the mould surface. This design depends upon periodic small pressure changes within the meniscus area between the molten metal and the top of the mould cavity to draw lubricant from the reservoir.

Another attempt at trying to assure the supply of lubricant along the entire length of a mould surface is described in Pryor et al U.S. Pat. No. 4,420,030, issued Dec. 13, 1983. This uses discrete lubricant feed holes extending through the mould and utilizes delivery holes of differing sizes to deliver different amounts of lubricant.

Typical lubricants used for this purpose include castor oil, rapeseed oil, other vegetable or animal oils, esters, paraffins, other synthetic liquids, and any other suitable lubricants typically utilized in the casting art. These materials all have a substantial viscosity and moving them through relatively small conduits results in considerable friction loss or drag. This friction loss is inversely proportional to the diameter to the fifth power of the passage.

It is the object of the present invention to provide an improved lubricant delivery system which compensates for the friction losses during lubricant delivery such that a uniform flow of lubricant is provided along the entire length of the mould surface.

SUMMARY OF THE INVENTION

According to the present invention an apparatus is provided for casting molten metal. This includes a mould for effecting solidification of the molten metal into a formed metal product, means adjacent to an inlet portion of the mould for feeding the molten metal into the mould and means for delivering a lubricating agent to a surface of the mould contacting the molten metal to substantially prevent adhesion of any solidified metal on the surface.

The lubricant delivery system includes at least one lubricant delivery channel arranged generally parallel to the mould surface. Inlet means is provided for delivering a flow of lubricant (oil) under pressure into the delivery channel. A plurality of small flow passages extend between the delivery channel and the mould surface for delivery of lubricant from the channel to the mould surface.

The present inventor has found that when the delivery channel is required to have a rather small cross sectional area, e.g. having an effective diameter of less than about 25 mm, there are serious problems in uniform delivery of lubricant to the mould surface because of high friction losses within the delivery channel. According to the present invention, a system and procedure have been developed in which the total friction loss of the system can be proportionally increased downstream from the delivery channel such that the friction loss from the lubricant flow in the delivery channel is negligible relative to the total friction loss of the system. The result of this is that lubricant delivered under pressure to the delivery channel is transferred uniformly from that channel through the flow passages to the mould surface.

A preferred embodiment of the novel lubricant delivery system of the present invention includes at least two lubricant delivery channels arranged generally parallel to the mould surface. These include a secondary channel laterally spaced a predetermined distance from the mould surface to be lubricated and a primary channel spaced from the secondary channel. Inlet means are provided for delivering a flow of lubricant under pressure into the primary lubricant channel.

A plurality of uniformly spaced first restrictive flow passages extend across between the primary and secondary channels and a plurality of uniformly spaced second restrictive flow passages extend across between the secondary channel and lubricant outlet holes at the mould surface for delivery of lubricant to the mould surface. The second restrictive flow passages have effective diameters smaller than the first restrictive flow passages and the first restrictive flow passages have effective diameters smaller than the lubricant channels. In this manner, the frictional loss from the lubricant flow in the primary lubricant channel is negligible relative to the total friction loss of the total system whereby lubricant delivered under pressure to the primary lubricant channel is transferred uniformly through the second restrictive flow passages to the mould surface.

Typically the second restrictive flow passages have smaller diameters, are shorter and are more closely spaced than are the first restrictive flow passages. While the required friction losses are typically based on the diameter of the restrictive flow passages, any combination of diameters, lengths and spacings of these passages may be used to obtain the required friction losses. In a typical example, the first restrictive flow passages have diameters of 1.2 mm, lengths of 30 mm and lateral spacings of 100 mm while the corresponding second restrictive passages have diameters of 0.5 mm, lengths of 6 mm and lateral spacings of 12.7 mm. These may be used with delivery channels having effective diameters of 5.1 mm.

The lubricating agent delivery system of this invention may be used with moulds for a variety of ingot shapes, including extrusion and sheet ingot, with or without insulated or hot tops. It is of particular value with a casting device having a mould having an inner, axially extending wall defining a mould cavity, and an insulating head member formed of a heat insulating material having a first portion extending transversely over at least a part of the mould cavity and a second portion contiguous with the upper mould surface.

The lubricant delivery channel or channels and the flow passages can be formed in an oil plate positioned on top of a mould or directly within the mould itself or portions thereof may even be formed within the insulating head member. The flow passages extending between the delivery channel and the mould surface may be discrete holes formed in one of the above or they may be in the form of grooves formed either in the top face of the mould or in the bottom face of an oil plate.

For effective operation of the present invention, the friction loss of the lubricant flow in the delivery channel is preferably less than 10% relative to the total friction loss of the total system, with a ratio of less than 5% being particularly preferred.

BRIEF DESCRIPTION OF THE DRAWINGS

The invention will be more fully understood from the following description of embodiments thereof, given by way of example only, with reference to the accompanying drawings, in which.

DESCRIPTION OF THE PREFERRED EMBODIMENTS

Figure 1:
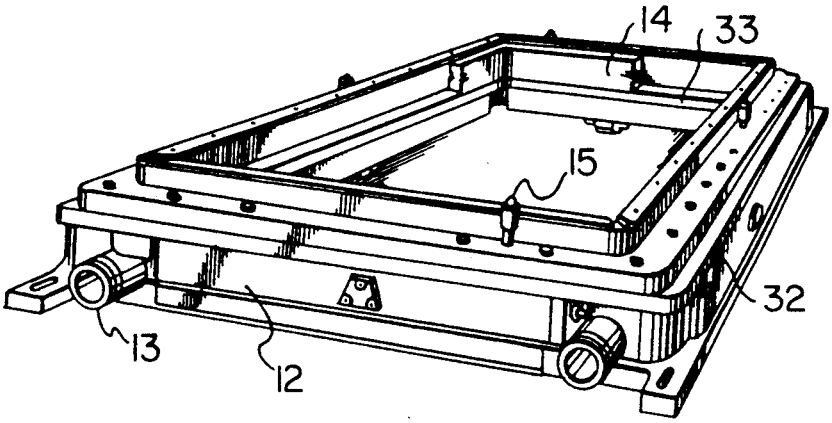
FIG. 1 is a perspective view of an insulated sheet ingot mould assembly.

The embodiment shown in FIG. 1 is a mould assembly having an open-ended rectangular body configuration. A mould plate 32 has a vertical mould face 33 which comes in contact with the molten metal. A coolant manifold 12 is fed with coolant through inlet 13 for the purpose of cooling the mould surface.

The inlet portion of the mould assembly includes an insulating head 14 which generally conforms to the shape of the mould with which it is associated. This insulating head is formed of a heat resistant and insulating material, such as a refractory material, which will not deteriorate when in contact with the molten metal to be cast. This head 14 is located at a position contiguous with or adjacent to and extending around the periphery of the top portion of the mould wall face 33. The use of such insulating head provides a relatively constant withdrawal of heat from the molten metal during the casting operation when using a short mould wall.

For casting an ingot, molten aluminum is fed into the insulating head 14 and is chilled while passing mould plate wall face 33 sufficiently to form an outer skin. This is further cooled by water sprays.

Lubrication System

Figure 2:
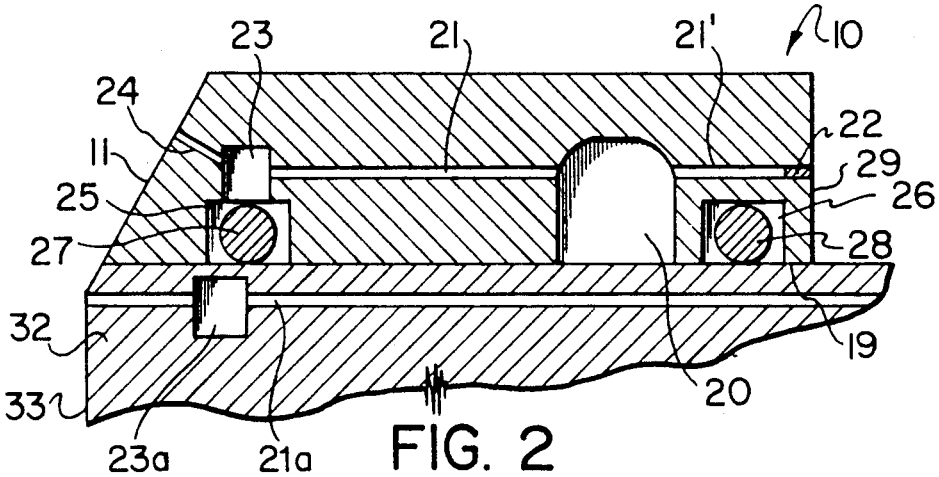
FIG. 2 is a cross section of an oil plate showing the lubricant delivery system of the invention.

The oil delivery system of this invention is illustrated in FIGS. 2 to 6 and is intended to provide a uniform distribution of oil on the mould face under all casting conditions. In the embodiment of FIG. 2, an oil plate 10 on top of mould 32 includes a large primary channel 20 extending generally parallel to the oil plate face 11 and mould face 33 and remote therefrom. A secondary delivery channel 23 of smaller cross sectional dimension is positioned spaced from primary channel 20 and also spaced a short distance from oil plate face 11. A plurality of restrictive passages 21 extend across between channels 20 and 23. These are drilled from face 29 of oil plate 10 with a portion 21' extending from end 29 to channel 20 and the main passage 21 then extending between channels 20 and 23. After these holes have been drilled, the ends at wall 29 are plugged by means of plugs 22. A plurality of second restrictive passages 24 extend between channel 23 and oil plate face 11.

In the bottom face 19 of oil plate 10 slots 25 and 26 are provided for O-rings 27 and 28 respectively. These O-rings serve to seal the oil plate on top of mould 32.

Figure 3:
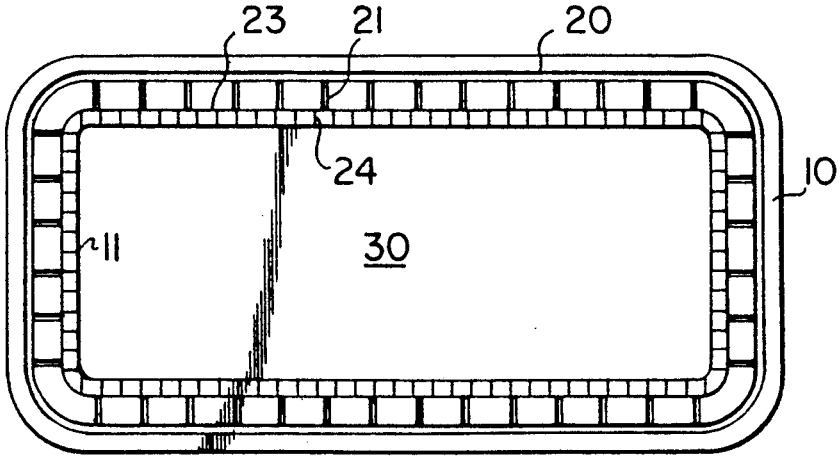
FIG. 3 is a schematic plan view of the lubricant delivery system of FIG. 2.
Figure 4:
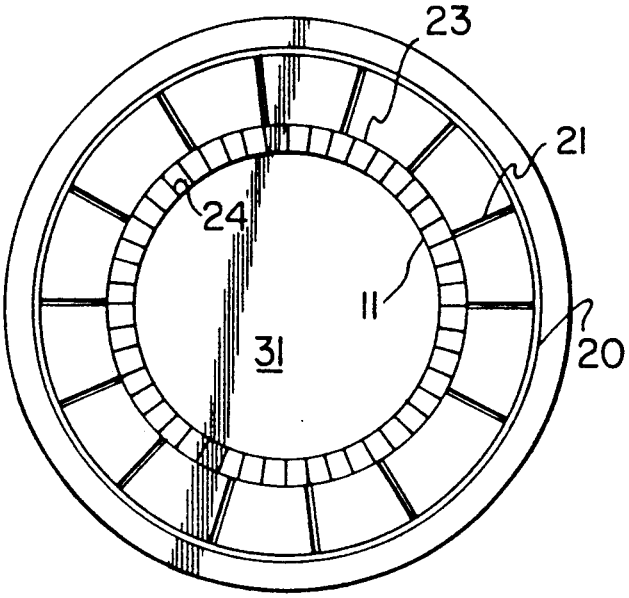
FIG. 4 is a schematic plan view of an extrusion ingot mould.

FIG. 3 is a schematic plan view which generally shows the rectangular mould assembly with the mould cavity 30, primary delivery channel 20, secondary delivery channel 23, restrictive passages 21 and restrictive passages 24. FIG. 4 shows an extrusion ingot mould having a mould cavity 31, together with the primary channel 20, the secondary channel 23, cross passages 21 and oil delivery passages 24.

Figure 5:
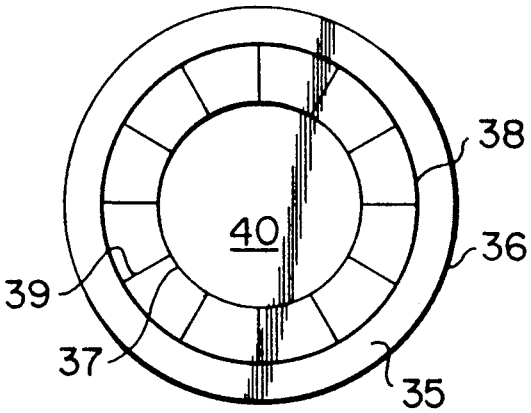
FIG. 5 is a schematic plan view of an extrusion ingot mould with a single delivery channel.
Figure 6:
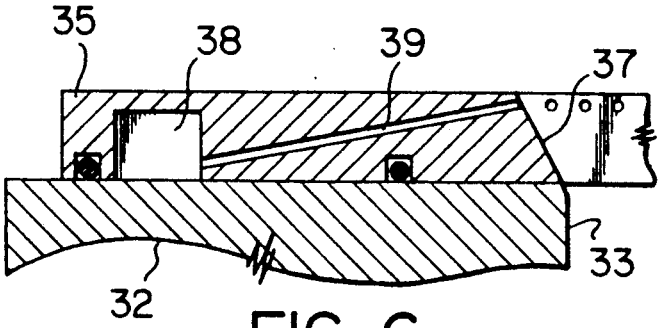
FIG. 6 is a cross section of the system of FIG. 5.

In the arrangement shown in FIGS. 5 and 6, an oil plate 35 is position on top of a mould 32 having a mould face 33. The oil plate has an outer edge face 36 and an inner edge face 37 which contacts the molten metal. A lubricant channel 38 of relatively large effective diameter is provided in the oil plate and a plurality of equally spaced restrictive passages 39 extend between channel 38 and oil plate edge face 37.

At least one of the lubrication delivery passages may be formed in a portion of the mould itself. FIG. 2 illustrates a mould 32 similar to the one shown in FIG. 1, but including lubrication delivery channels and passages. The mould 32 illustrated in FIG. 2 has at least one channel **23*a* and passage 21*a* formed in the mould 32**.

It has been found that when the diameters, lengths and numbers of restrictive passages 39 are selected such that the total friction loss of the system is sufficiently high that the friction loss from the channel 38 is less than 10%, preferably less than 5%, of the total friction loss to the total system, the lubricant is delivered uniformly through the plurality of restrictive flow passages 39.

Preferred embodiments of this invention are illustrated by the following examples. In the tables shown, the friction head loss values are calculated using a formula derived from the Darcy-Weisbach formula as follows:

$$Hd\ \text{loss} = \frac{f \times L \times Q^2}{2g \times 0.616 \times d^5}$$

in which

Hd is friction head loss

L is the length of restrictions

Q is the fluid flow rate
g is the gravity of the fluid
d is the diameter of restriction
f is the friction factor for laminar flow for the fluid used and is 64/Reynolds No.

EXAMPLES

EXAMPLE 1

A series of tests were conducted utilizing a system as illustrated in attached FIG. 2.

The arrangement used had the following characteristics:

Length of primary channel (20): 2600 mm
Diameter of primary channel (20): 5.1–19 mm
Viscosity of oil: 346 centistokes
Oil flow rate: 122 ml/min
Spacing between primary restrictions: 75 mm
Length of primary restrictions (21): 30 mm
Diameter of primary restrictions (21): 1 mm
Equivalent diameter of secondary channel (23): 5.1 mm
Spacing between secondary restrictions: 25.4 mm
Length of secondary restrictions (24): 6.2 mm
Diameter of secondary restrictions (24): 0.5 mm Determinations were made on the effect of varying the diameter of the primary channel. This was varied between 5.1 and 19 mm. The results of this variation in the diameter of the primary channel are shown in Table 1 below.

TABLE 1

| Dia. of primary channel (mm) | 5.1 | 7 | 9 | 11 | 12.7 | 19 |
|---|---|---|---|---|---|---|
| Total friction loss in primary channel (kPa) | 56.6 | 16.0 | 5.8 | 2.6 | 1.5 | 0.29 |
| Friction variation - start to end of primary channel (%) | 99.8 | 99.8 | 99.8 | 99.8 | 99.8 | 99.8 |
| Friction loss in primary restriction (kPa) | 25.3 | 25.3 | 25.3 | 25.3 | 25.3 | 25.3 |
| Friction loss in secondary channel (kPa) | 9.5 | 9.5 | 9.5 | 9.5 | 9.5 | 9.5 |
| Friction loss in secondary restriction (kPa) | 13.9 | 13.9 | 13.9 | 13.9 | 13.9 | 13.9 |
| Theoretical total pressure in first hole (kPa) | 95.9 | 55.2 | 45.1 | 41.9 | 40.7 | 39.5 |
| Theoretical total pressure in last hole (kPa) | 39.3 | 39.3 | 39.3 | 39.2 | 39.2 | 39.2 |
| Uniformity variation in percent | 56.1 | 18.6 | 7.2 | 3.3 | 1.9 | 0.37 |
| Ratio of primary channel resistance/ total system resistance (%) | 59.0 | 28.9 | 12.9 | 6.2 | 3.6 | 0.7 |

*The total friction loss in primary channel (kPa) and friction variation - start to end of primary channel (%) are calculated with a uniform flow variation or it is assuming a uniform variation to establish the primary channel friction losses.

From the above results it will be seen that increasing the effective diameter of the primary channel has a very dramatic effect on the uniformity of the oil delivery. It furthermore shows that when space constraints necessitate the use of an oil delivery channel of small effective diameter, there are problems in lubricant distribution.

EXAMPLE 2

The same system and same general procedure was used as described in Example 1, but in this case the diameter of the primary channel was fixed at a rather small size of 5.1 mm and the diameter of the primary restrictions was varied between 0.4 and 2 mm. The results obtained are shown in Table 2.

From the results obtained in Table 2, it is evident that the problems shown in Table 1 when a small primary channel diameter of 5.1 mm was used can be solved by varying the diameters of the primary restrictions. Thus, when these were reduced down to a diameter of less than 0.5 mm, a very high degree of uniformity was achieved.

TABLE 2*

| Dia. of primary restriction (mm) | 2 | 1.9 | 1.8 | 1.6 | 1.4 | 1.2 | 1.0 | 0.8 | 0.7 | 0.6 | 0.55 | 0.5 | 0.45 | 0.4 |
|---|---|---|---|---|---|---|---|---|---|---|---|---|---|---|
| Total friction loss in primary channel (kPa) | 56.6 | 56.6 | 56.6 | 56.6 | 56.6 | 56.6 | 56.6 | 56.6 | 56.6 | 56.6 | 56.6 | 56.6 | 56.6 | 56.6 |
| Friction variation - start to end of primary channel (%) | 99.8 | 99.8 | 99.8 | 99.8 | 99.8 | 99.8 | 99.8 | 99.8 | 99.8 | 99.8 | 99.8 | 99.8 | 99.8 | 99.8 |
| Friction loss in primary restriction (kPa) | 1.6 | 1.9 | 2.4 | 3.8 | 6.6 | 12.2 | 25.3 | 61.7 | 105.2 | 195.0 | 276.2 | 404.3 | 616.2 | 987.1 |
| Friction loss in secondary channel (kPa) | 9.5 | 9.5 | 9.5 | 9.5 | 9.5 | 9.5 | 9.5 | 9.5 | 9.5 | 9.5 | 9.5 | 9.5 | 9.5 | 9.5 |
| Friction loss in secondary restriction (kPa) | 13.9 | 13.9 | 13.9 | 13.9 | 13.9 | 13.9 | 13.9 | 13.9 | 13.9 | 13.9 | 13.9 | 13.9 | 13.9 | 13.9 |
| Theoretical total pressure in first hole "PTPT" (kPa) | 72.2 | 72.6 | 73.0 | 74.5 | 77.2 | 82.8 | 95.9 | 132.3 | 175.9 | 265.6 | 346.8 | 474.9 | 686.9 | 1057.7 |
| Theoretical total pressure in last hole "PTDT" (kPa) | 15.6 | 16.0 | 16.5 | 17.9 | 20.6 | 26.2 | 39.3 | 75.8 | 119.3 | 209.1 | 290.2 | 418.4 | 630.3 | 1001.2 |
| Uniformity variation in percent | 114.8 | 112.9 | 110.5 | 103.8 | 93.4 | 77.6 | 56.1 | 32.2 | 21.4 | 12.7 | 9.3 | 6.5 | 4.4 | 2.8 |
| Rates of primary channel resistance/ total system resistance (%) | 78.3 | 77.9 | 77.5 | 76.0 | 73.3 | 68.3 | 59.0 | 42.8 | 32.2 | 21.3 | 16.3 | 11.9 | 8.2 | 5.3 |

*The total friction loss in the primary channel (kPa) and the friction variation - start to end of primary channel (%) are calculated assuming a uniform flow variation in the primary channel.

We claim:

1. An apparatus for casting molten metal comprising: a mould for effecting solidification of the molten metal into a formed metal product, means adjacent to an inlet portion of said mould for feeding said molten metal into the mould and means for delivering a lubricating agent to a surface of said mould contacting the molten metal to substantially prevent adhesion of any solidified metal on said surface, characterized in that the lubricating agent delivery means comprises at least one lubricant delivery channel arranged generally parallel to the mould surface, inlet means for delivering a flow of lubricant under pressure into said channel, a plurality of uniformly spaced restrictive flow passages extending across between said delivery channel and lubricant outlet holes adjacent the molten metal for delivery of lubricant to the mould surface, said restrictive flow passages having dimensions such that the friction loss from lubricant flow in the lubricant delivery channel is less than 10% of the total friction loss of the total system whereby lubricant delivered under pressure to said lubricant channel is transferred uniformly through said restrictive flow passages to the mould surface.

2. An apparatus according to claim 1 wherein the delivery channel and passages are formed in an oil plate mounted on top of the mould.

3. An apparatus according to claim 1 wherein at least one of said channel and passages is formed in the mould.

4. An apparatus according to claim 1 wherein the delivery channel has an effective diameter of less than 25 mm.

5. An apparatus for casting molten metal comprising: a mould for effecting solidification of the molten metal into a formed metal product, means adjacent to an inlet portion of said mould for feeding said molten metal into the mould and means for delivering a lubricating agent to a surface of said mould contacting the molten metal to substantially prevent adhesion of any solidified metal on said surface, characterized in that the lubricating agent delivery means comprises at least two lubricant delivery channels arranged generally parallel to the mould surface, including a secondary channel laterally spaced a predetermined distance from the mould surface to be lubricated and a primary channel spaced from the secondary channel, inlet means for delivering a flow of lubricant under pressure into said primary channel, a plurality of uniformly spaced first restrictive flow passages extending across between said first and second channels and a plurality of uniformly spaced second restrictive flow passages extending across between said second channel and lubricant oulet holes adjacent the molten metal for delivery of lubricant to the mould surface, said second restrictive flow passage having effective diameters smaller than said first restrictive flow passages and said first restrictive flow passages having effective diameters smaller than said lubricant channels, such that the friction loss from lubricant flow in the first lubricant channel is less than 10% of the total friction loss of the total system whereby lubricant delivery under pressure to said first lubricant channel is transferred uniformly through said second restrictive flow passages to the mould surface.

6. An apparatus according to claim 5 wherein the delivery channels and passages are formed in an oil plate mounted on top of the mould.

7. An apparatus according to claim 5 wherein at least one of said channels and passages is formed in the mould.

8. An apparatus according to claim 1 wherein the dimensions provide a friction loss from flow in said delivery channel which is less than 5% of the total friction loss of the total system.

9. In a process for the production of metal ingots by the continuous casting process comprising the steps of (a) providing means for supplying molten metal to a mould adjacent the inlet portion of the mould, (b) feeding molten metal into the mould, (c) at least partially solidifying the molten metal within the mould and (d) withdrawing the at least partially solidified molten metal from the mould, the improvement which comprises providing at least one lubricant delivery channel arranged generally parallel to the mould surface, inlet means for delivering a flow of lubricant under pressure into said channel, a plurality of uniformly spaced restrictive flow passages extending across between said delivery channel and lubricant outlet holes adjacent the molten metal for delivery of lubricant to the mould surface, and flowing lubricant through said channel and passages such that the friction loss from lubricant flow in the lubricant delivery channel is less than 10% of the total friction loss of the total system whereby the lubricant is transferred uniformly through said restrictive flow passages to the mould surface.

10. A process according to claim 9 wherein the friction loss from the flow of lubricant in the delivery channel is less than 5% of the total friction loss of the total system.

11. A process according to claim 9 wherein two laterally spaced lubricant delivery channels are used, with uniformly spaced first restrictive flow passages extending across between the two delivery channels for transferring lubricant from a first channel to a second channel and uniformly spaced second restrictive flow passages extending across between said second channel and lubricant outlet holes adjacent the molten metal for delivery of lubricant from the second channel to the mould surface, and flowing lubricant through said channels and passages such that the friction loss from lubricant flow in the first lubricant delivery channel is negligible relative to the total friction loss of the total system whereby the lubricant is transferred uniformly through said second restrictive flow passages to the mould surface.

* * * * *